United States Patent [19]

Rayfield et al.

[11] 4,118,022

[45] Oct. 3, 1978

[54] BURSTING APPARATUS FOR CONTINUOUS FORMS

[75] Inventors: Wilson Parker Rayfield, Pittsford; Ronald Worden Ferguson, Rochester; George Mahue Brooks, Pittsford, all of N.Y.

[73] Assignee: Burroughs Corporation, Detroit, Mich.

[21] Appl. No.: 785,896

[22] Filed: Apr. 8, 1977

[51] Int. Cl.[2] ..... B65H 41/00

[52] U.S. Cl. ..... 270/52.5; 225/100

[58] Field of Search ..... 270/52.5; 225/4, 5, 225/100-101

[56] References Cited

U.S. PATENT DOCUMENTS

| | | | |
|---|---|---|---|
| 439,861 | 11/1890 | Brooks | 225/100 |
| 3,146,927 | 9/1964 | Peterson | 225/100 |
| 3,847,318 | 11/1974 | Parenti | 225/100 |
| 4,018,431 | 4/1977 | Schueler | 270/52.5 |

FOREIGN PATENT DOCUMENTS

| | | | |
|---|---|---|---|
| 609,031 | 11/1960 | Canada | 225/100 |
| 2,364,035 | 8/1974 | Fed. Rep. of Germany | 225/100 |

*Primary Examiner*—Edgar S. Burr
*Assistant Examiner*—A. Heinz
*Attorney, Agent, or Firm*—Dale V. Gaudier; Edward J. Feeney; Kevin R. Peterson

[57] ABSTRACT

Bursting apparatus for continuous forms having modular guiding, trimming, bursting, and decollating units. A folding forms tray is provided to hold forms to be burst. Paper feeding and guiding is accomplished by the use of laterally adjustable curved, flanged guide means coacting with spring loaded hold-downs. Margin trim cutters and a center slitter are also provided. Forms width and margin trim adjustments are readily accomplished through the use of novel leaf-spring clamping means coacting with transverse guiding means.

The bursting unit has fixed high speed rollers and movable low speed rollers with a bursting blade having plural arcuately shaped bursting areas attached thereto. The low speed rollers are mounted on a movable carriage which is adjustably spaced from the fixed high speed rollers by means of two parallel threaded rods.

Annular grooves are provided in both the low and high speed rollers to permit straight through wire-form guides to direct the forms continuously through the bursting section and thence to a stacking unit. Further, the low speed and high speed rollers are tilted away from each other to cause a more uniform bursting action and to ensure that the burst forms are ejected downward toward the stacking unit. A compact folding shingling stacker or tray stacker is described which may be readily attached to the fixed high speed roller unit.

In addition, decollator, carbon take-up, refold bin, and trim bin units are described.

24 Claims, 9 Drawing Figures

BURSTING APPARATUS FOR CONTINUOUS FORMS

BACKGROUND OF THE INVENTION

The invention relates to the field of automatic bursting of perforated continuous forms. More particularly, the invention relates to modular apparatus for bursting forms which includes dual speed rollers and a bursting blade to accomplish form separation, and paper guiding, trimming and stacking means.

The growth of modern high speed data processing and printing has led to the use of continuous web materials as printing media. Generally, whether they take the form of invoices, paychecks, ledger sheets, or the like, such forms come in a variety of sizes. Most modern forms have margins containing sprocket holes for use with the well known tractor pins drive used on high speed data printing equipment. Most forms also include pre-weakened areas or perforations which allow the forms to be readily separated from one another. In addition, many uses of such forms require the generation of one or more copies, and continuous forms are often provided with manifold sets of carbons and copy layers.

However, with the increased utilization of such continuous forms, a concomitant increase in the need for simple and reliable automatic bursting apparatus has been felt. However, up until now, most such units were noisy, bulky, mechanically complex, have required time consuming adjustments for changing from sizes, and were prone to troublesome jamming or misregistration of the forms, thus causing great delay in processing of the forms.

Well known prior art devices commonly use a pair of high speed rollers and a pair of low speed rollers coacting with a bursting blade to cause separation along the preweakened zones of suitable continuous forms. Generally, the forms would be guided to the bursting unit by a pair of mechanically complex tractor pin drives which were adapted to engage sprocket holes provided along the margins of the forms. Such prior art guiding means suffer from the obvious disadvantage that only forms provided with standard sprocketed margins can be used in the machine. Before passing on to the bursting unit these sprocketed margins would generally be removed by a pair of dual rotating trimmer blades disposed in the forms path. Thus, before being burst, prior art devices require that both the tractor pin guides and the trim cutter units, which ride on transverse guide rods, be exactly aligned. Especially critical is the alignment of the tractor pin guides which, if not properly aligned, or securely locked onto their transverse guide rods, will cause the forms to be skewed, resulting in the forms being crumpled, improperly burst, or even torn. Prior art devices have attempted to overcome these problems by providing positive locking and stop means for the paper guides and trimmer units. These positive locking means usually have taken the form of some sort of thumbscrew, or lever operated camming device to lock the trimming and guiding units in place along a transverse guide rod. However, in order to prevent side to side play while forms are being fed into the machine, small stop blocks, also operated by thumbscrew or lever operated camming devices have been employed. Thus to load a form into prior art devices, an operator must first loosen a set screw or release a locking device on both the tractor pin units and their respective stop blocks, precisely align the tractor pin unit up with the sprocket holes of the forms, and relock or refasten all the above elements. The same sequence of steps of unlocking, resetting, alignment, and relocking must be followed for the trimmer units, which steps often present a hazard to the operator since the locking mechanism on the trimmer units is often quite close to the sharp blades of the trimmers.

In well known prior art devices the trimmed forms then continue on to a pair of fixed low speed rollers, having a bursting bar disposed thereon, and thence to a pair of movable high speed rollers. Generally, the high speed rollers are supported by a toothed track arrangement. This arrangement necessitates forming the tracked portions in heavy side plates which can withstand the high stresses generated during the bursting operation. However, such an arrangement necessitates the use of heavy materials and a bulky structure of stamped metal side plates to house the fixed low speed rollers and the movable high speed rollers. Additionally since all the load bearing stresses are present in the side plates a high degree of undesirable mechanical noise is present whenever a form is being burst. Furthermore, if a shingling stacker is desired, it must be attached securely to the movable high speed end for movement therewith, which results in an undesirable increase in the mechanical complexity of the unit and also makes it more difficult for the operator to adjust for different size forms since greater mechanical force is required to simultaneously move the high speed roller unit and the shingling stacker. Even those prior art bursting devices which have movable low speed rollers and fixed high speed rollers have used the above mentioned stamped metal side plates and toothed track arrangement to support and adjustably separate the high and low speed rollers. Additionally, prior art bursters make little provision for properly guiding the forms once they enter the bursting section. Generally a flat bed or platen is provided between the low speed and high speed rollers, with pressure rollers or wheels which are used to help keep the forms skewing or misregistering. However, such techniques are subject to undesirable aerodynamic problems in that thin forms often will not properly glide across the bed under the rollers and therefore be skewed, improperly burst, or jam the bursting apparatus. Additionally, such guiding means is bulky and expensive to manufacture.

SUMMARY OF THE INVENTION

It is therefore an object to provide apparatus for bursting continuous forms which is light in weight, mechanically simple, quiet in operation, and which requires a minimum of operator adjustments.

It is a further object to provide bursting apparatus having modular forms guiding, trimming, bursting and decollating means.

It is an additional object to provide bursting apparatus having improved forms guiding means which can handle both sprocketed and unsprocketed continuous forms.

It is yet further object to provide bursting apparatus having novel quick-clamping means for adjustably locking both the forms guiding means and the margin trimming means.

It is yet an additional object to provide bursting apparatus having improved bursting means, wherein there is provided improved forms length adjustment and guiding means.

It is a still further object to provide bursting apparatus having improved guiding means for guiding the forms through the bursting means.

These and other objects of the invention are achieved by providing a modular bursting apparatus having dual curved, flanged forms guide means and dual margin trimming means, each transversely adjustable with respect to each other through the use of novel leaf-spring clamping means. Bursting means, adapted to receive forms from the guide means and trimming means is provided, comprising two pairs of oppositely tilted low speed and high speed rollers, wherein the pair of low speed rollers are mounted on movable carriage means adjustably spaced from the pair of fixed high speed rollers by means of two parallel threaded rods. Linear pressure means, adapted to coact with preweakened zones on the forms, is mounted on the movable carriage. Guiding means, substantially enclosing the space bounded by the parallel rods and the low and high speed rollers, are provided to direct the forms through the bursting means. Means are also provided for holding the forms to be burst, to decollate and retrieve carbon and copies, and to stack the burst forms.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENT

Figure 1:
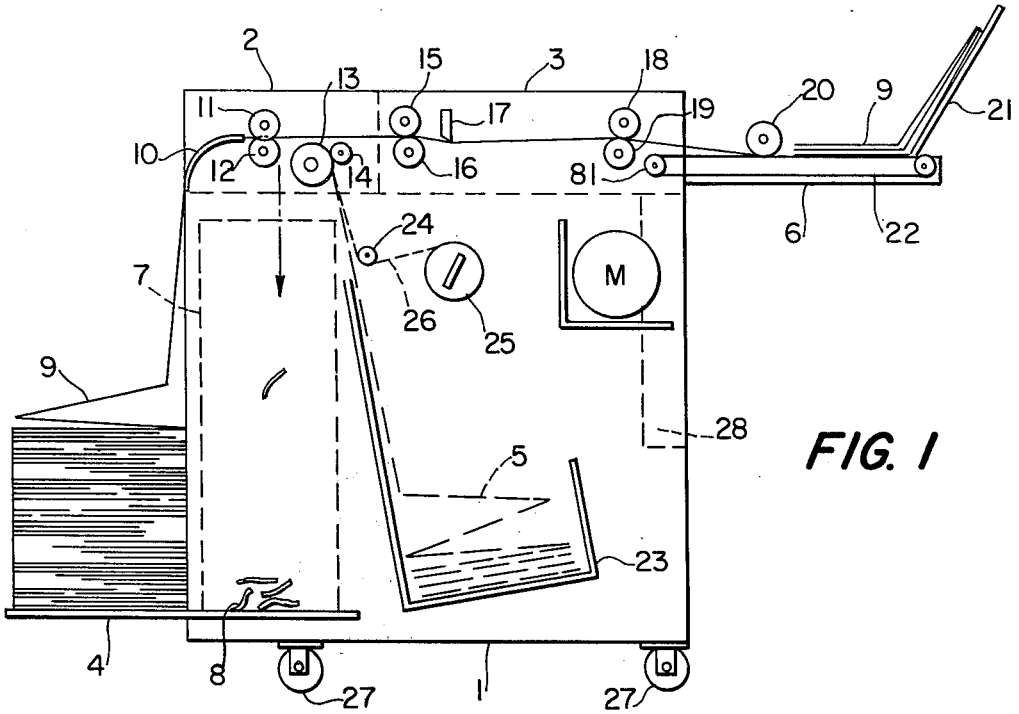
FIG. 1 is an idealized side view of the modular bursting apparatus of the present invention, showing the relationship of the major mechanical components with respect to the path of the forms to be burst.

Referring to FIG. 1 of the drawings, there is shown an idealized side view of a continuous forms bursting apparatus having a frame and cabinet 1, resting on casters 27, generally four in number. A flip-up loading tray 4 is shown with continuous forms 9 stacked thereupon. Continuous forms 9 are shown entering the guide/trim module, generally denoted as 2, and passing over a pair of flanged, transversely adjustable guides 10. Continuous forms 9 then pass through a pair of vertically disposed circular rotating trimmer blades 11 and 12, which are also transversely adjustable. Any trimmed paper, indicated at 8, will fall into trim bin 7.

The decollator unit, comprised of decollator drum 13 and decollator guide roller 14, are well-known in the art and act to separate a carbon and one or more copies, if a manifold copying forms set is used. The decollator unit is used to separate the carbon from a manifold copying set, refold the copies of the forms not to be burst, or both. Such an arrangement is needed, for example when it is desired to burst the originals of a manifold copying set but have the copies remain continuous. Decollator drum 13 has a rough surface, such as emery or sandpaper, whereas decollator guide 14 may be of any hard material, for instance cold rolled steel. Carbon 26 passes under carbon guide 24 and thence to carbon take-up reel 25. Take-up reel 25 is a type well-known in the art and only requires that the operator initially wind a few turns of carbon 26 over take-up reel 25 before automatic operation can begin. Carbon 26 can be removed from reel 25 without removing the reel from cabinet 1. This is accomplished by providing a flexible universal joint in the carbon take-up reel drive (not shown). Carbon 26 rolled take-up reel 25 is the ply between decollated copies 5 and original forms 9. The operator can decollate any portion of the total plies of a manifold copying set. Decollated copies 5 will be caught in refold pin 23 for later removal and refiling by the operator.

The original continuous forms 9 pass from the guiding/trimming module 2 to the bursting module shown generally at 3. Continuous forms 9 pass through the vertically tilted linearly adjustable low speed rollers denoted at 15 and 16. The forms pass under bursting blade 17 and then into the vertically tilted fixed high speed rollers denoted at 18 and 19. Due to the differential speeds between the low speed rollers 15 and 16 and the high speed rollers 18 and 19, stresses will be built up along preweakened zones of the continuous forms 9. The spacing between the high speed and low speed roller units is normally adjusted so that these preweakened zones occur directly below bursting blade 17. The high speed and low speed rollers are driven by a series of belts and pulleys (not shown) by motor M. Burst forms are ejected onto shingling stacker 6 which has a number of endless belts, denoted at 22, which are driven by transverse roller bar 81 through a series of belts and pulleys (not shown) from motor M. Shingling roller 20 insures that burst forms 9 remain in close contact with belts 22 so as to provide a more even stacking arrangement. Adjustable form rest 21 may be set at any angle from 90° to 0°. In the preferred embodiment shingling stacker 6 is pivotally attached to the high speed end of bursting unit 3 through transverse roller bar 81, near the high speed rollers 18 and 19. Since the high speed rollers are fixed, this arrangement allows shingling stacker 6 to fold down into a recess 28 provided in the side of cabinet 1 when the machine is not in use, thus creating a more compact unit. Of course, shingling stacker 6 could be replaced by a simple spring loaded tray or bin well-known in the art; however, greater operator efficiency can be had if shingling stacker 6 is used since it allows removal of the burst forms while the bursting apparatus is running.

Figure 2:
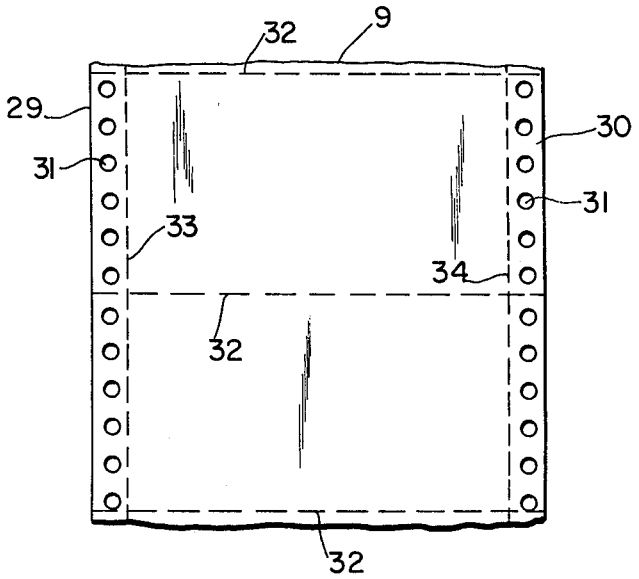
FIG. 2 shows an example of a typical sprocketed continuous form which the invention is designed to burst.

An example of a typical continuous form as might be used in the invention is shown in FIG. 2. Continuous form 9 has a plurality of printing areas bounded by left and right hand margins 29 and 30, respectively, and a plurality of inter-form perforations or preweakened areas 32. Both left and right hand margins 29 and 30 may also be provided with marginal perforations 33 and 34 parallel to their respective left and right edges. Additionally, the forms may be provided with a plurality equispaced sprocket holes 31 which are adapted to engage the well-known tractor pin drives used in prior art bursters and data processing equipment. It will be noted however, that the present invention does not require the presence of sprocket holes 31 on forms to be burst since the present invention has guiding and feeding means adapted to handle both sprocketed and unsprocketed continuous forms, as discussed below.

Figure 3:
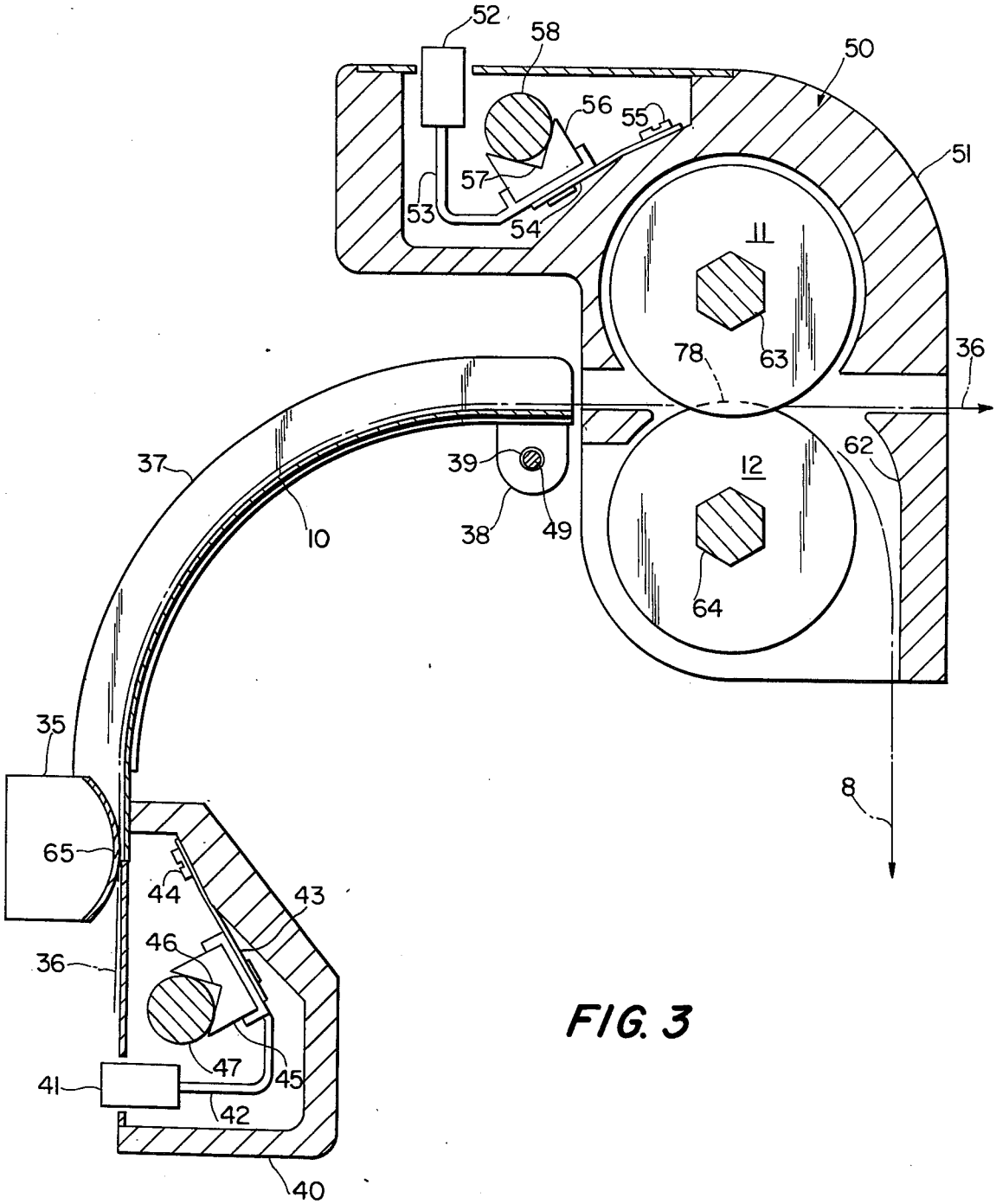
FIG. 3 is a detailed side view of one of a pair of identical forms guiding and trimming units.
Figure 4:
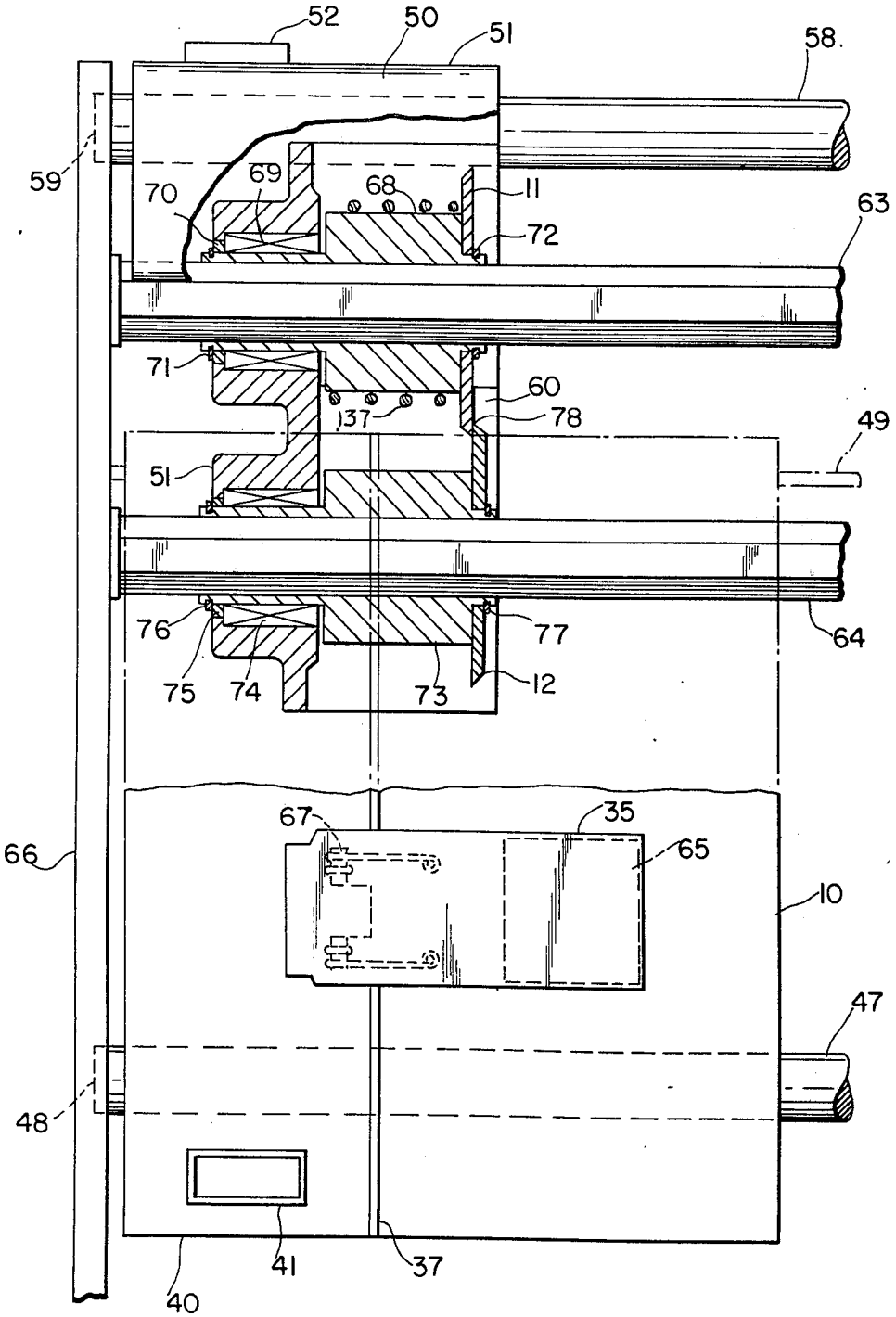
FIG. 4 is a partially fragmented end view of the left side forms guiding and trimming units shown in FIG. 3.

With reference to FIGS. 3 and 4 of the drawings, there are shown more detailed views of one of a pair of the guide/trim modules 2 shown in FIG. 1. The path of continuous forms 9 is generally indicated by dotted line 36. The forms would be drawn through the guide/trim module by the action of the low speed rollers 15 and 16 of the bursting unit, as described below. The path of the continuous forms first passes beneath hold-down 35 between bearing surface 65 and the arcuate forms guide 10. Hold-down 35 has a spring loaded closure indicated at 67 which acts to releasably secure a form which passes beneath bearing surface 65. Only a moderate force is desired since it is necessary that a form that is held beneath hold-down 35 be able to slideably move along form path 36. Also shown in FIG. 3 is flange 37 which is vertically disposed along the surface of forms guide 10 and which acts to define and control the lateral edges of the continuous forms. As can be seen from the drawings both forms guide 10 and flange 37 define the limit of travel of forms path 36, while hole-down 35 acts to releasably secure the forms 9 into sliding, engaging contact with the surface of forms guide 10.

The entire guiding unit, comprising hold-down 35, forms guide 10 and flange 37 is laterally adjustable along the length of shaft 47 and guide rod 49 for different width forms. Though only a left side guide unit is shown in FIG. 4, it is understood that an identical mirror image unit would be used to support and guide the right hand side of the forms. Shaft 47 is fitted in recess 48 and extends from left side support 66 to an identical recess in the right side support (not shown). In a like manner guide rod 49 extends from left side support 66 to an identical right side support (not shown).

Novel clamping means is shown in FIG. 3 and comprises push button 41, plunger 42, leaf spring 43, and resilient block 45, all contained in guide lock housing 40. Housing 40 is fixedly attached to the lower underside of forms guide 10 as shown in FIGS. 3 and 4. The location of housing 40 is purely a matter of choice, and is shown attached to the lower underside of forms guide 10 by way of example only. As is apparent from FIG. 3, guide lock housing 40 surrounds shaft 47. Push button 41 is fixedly attached to plunger 42 which in turn is fastened to the lower portion of leaf spring 43.

Resilient block 45 is mounted at the lower end of leaf spring 43 and has a V-shaped face 46 in contacting engagement with the surface of shaft 47. Resilient block 45 is preferably composed of a urethane-type material; however, any of a number of moderately resilient or elastic materials well known in the art may be used in place of urethane. The upper portion of leaf spring 43 is attached to the upper portion of housing 40 by fastening means 44. A flange 38, secured to the underside of forms guide 10, has an opening 39 which engages a guide rod 49 which is fixedly mounted to both right and left supports 66 in a spaced parallel relationship to shaft 47 as shown in FIGS. 3 and 4.

Pressure on push button 41 causes plunger 42 to move rearwardly with respect to housing 40. Rearward movement of plunger 42 causes leaf spring 43 to be bent slightly, thus causing partial or complete removal of frictional pressure placed on shaft 46 by resilient block 45, depending on the amount of pressure applied by the operator. Operator pressure on push button 41 allows ready adjustment of the forms width setting without the necessity for cumbersome thumbscrew or lever operated camming locks, or the resetting of stop blocks whenever the forms width setting is to be changed. Thus the novel clamping means as described consists of but a few simple mechanical elements, easily constructed, but allows positive, releasable locking for the forms width setting of the forms guide unit. In addition, since costly and mechanically complex tractor pin drives for the forms guide unit are eliminated, a simpler, more reliable, and less costly device results. Further, the above-described forms guiding means is operable with both sprocketed and unsprocketed forms, thus allowing greater flexibility in the types of forms which can be burst.

With reference to FIGS. 3 and 4, it can be seen that after leaving the forms guide 10, the continuous forms will enter a trimming unit, generally denoted at 50. Trimming unit 50 is comprised of trimmer housing 51 which encloses upper trimmer blade 11 and lower trimmer blade 12. Circular trimmer blades 11 and 12 are vertically disposed above one another along parallel hex shafts 63 and 64. Hex shafts 63 and 64 are rotatably supported by left side support 66 and a similar right side support (not shown). Hex shafts 63 and 64 are rotatable by means of a system of belts and pulleys (not shown) which are driven by motor M. Lower trim blade 12 is attached to lower blade spindle 73 which in turn engages a portion of hex shaft 64 for rotation therewith. Similarly, upper trim blade 11 is attached to upper blade spindle 68 which in turn engages a portion of hex shaft 63 for rotation therewith. Lower blade spindle 73 is rotatably joined to trimmer housing 51 by means of lower blade detent 77, lower bearing detent 76, lower bearing washer 75, and lower roller bearing 74. Similarly, upper blade spindle 68 is rotatably joined to trimmer housing 51 by means of upper blade detent 72, upper bearing detent 71, upper bearing washer 70, and upper roller bearing 69. In FIG. 4 it can be seen that the upper and lower trimmer blades engage their cutting surfaces along the area denoted at 78. Also shown is compression spring 137 disposed about upper spindle 68. Compression spring 137 acts to force upper blade 11 against lower blade 12 at area 78 to cause a self-sharpening effect of the trimmer blades. In addition, trimmer housing 51 encloses shaft 58 which has its left end mounted in recess 59 in the upper end of left side support 66 and its right end mounted in a similar recess in an identical right side support (not shown). Disposed about shaft 58 and coacting therewith is the trimmer lock unit, similar in construction to the guide lock unit described above, having a push button 52 attached to plunger 53, which in turn is attached to the lower end of leaf spring 54. The upper end of leaf spring 54 is securably fastened to the trimmer housing 51 by means of fastening means 55. Also attached to the lower end of leaf spring 54 is resilient block 56 having a V-shaped groove 57 disposed in contacting engagement with the surface of shaft 58. Resilient block 56 is identical in construction and materials as resilient block 45 described with respect to the guide lock unit above.

Pressure by the operator on pushbutton 52 causes plunger 53 to push leafspring 54 and resilient block 56 away from contacting engagement with shaft 58. In such a position the entire trimming unit 50 is freely moved laterally along hex shafts 63 and 64 and shaft 58, thus allowing ready adjustment of the amount of margin which is to be trimmed from a form.

Continuous forms leaving forms guide 10 enter the trimmer housing 51 and are guided into the trimming area 78 by aperture 60. The trimmed continuous forms exit through aperture 61 and travel along path 36 to the bursting module 3. The trimmed margins 8 are directed downward toward the trim bin 7 (shown in FIG. 1) by the trimmed margin guide 62.

The above left side trimmer unit has been described, by way of example only, and it is understood that an identical mirror image unit would be used in the invention to trim the right hand margin of continuous forms. In addition it is contemplated that a center slitter having similar construction and operation to that of the above-described trimmer unit could be used in the invention. Such a unit would be used to split continuous forms into two separate strips, such a result being desirable for certain types of multiple forms which are printed side by side. Thus it can be seen that the novel clamping means used in conjunction with the dual blade trimmer unit assures quick and positive adjustment of the amount of margin which is to be removed from the continuous forms, while providing a mechanically simple and inexpensive solution to prior art problems of positive adjustment and locking of trimmer units. Indeed, because of the fully enclosed and easily accessible nature of the adjustment, the operator's fingers need never be in close proximity to the sharp trimming blades or rotating shafts, thus greatly increasing safety for the operator.

Figure 5:
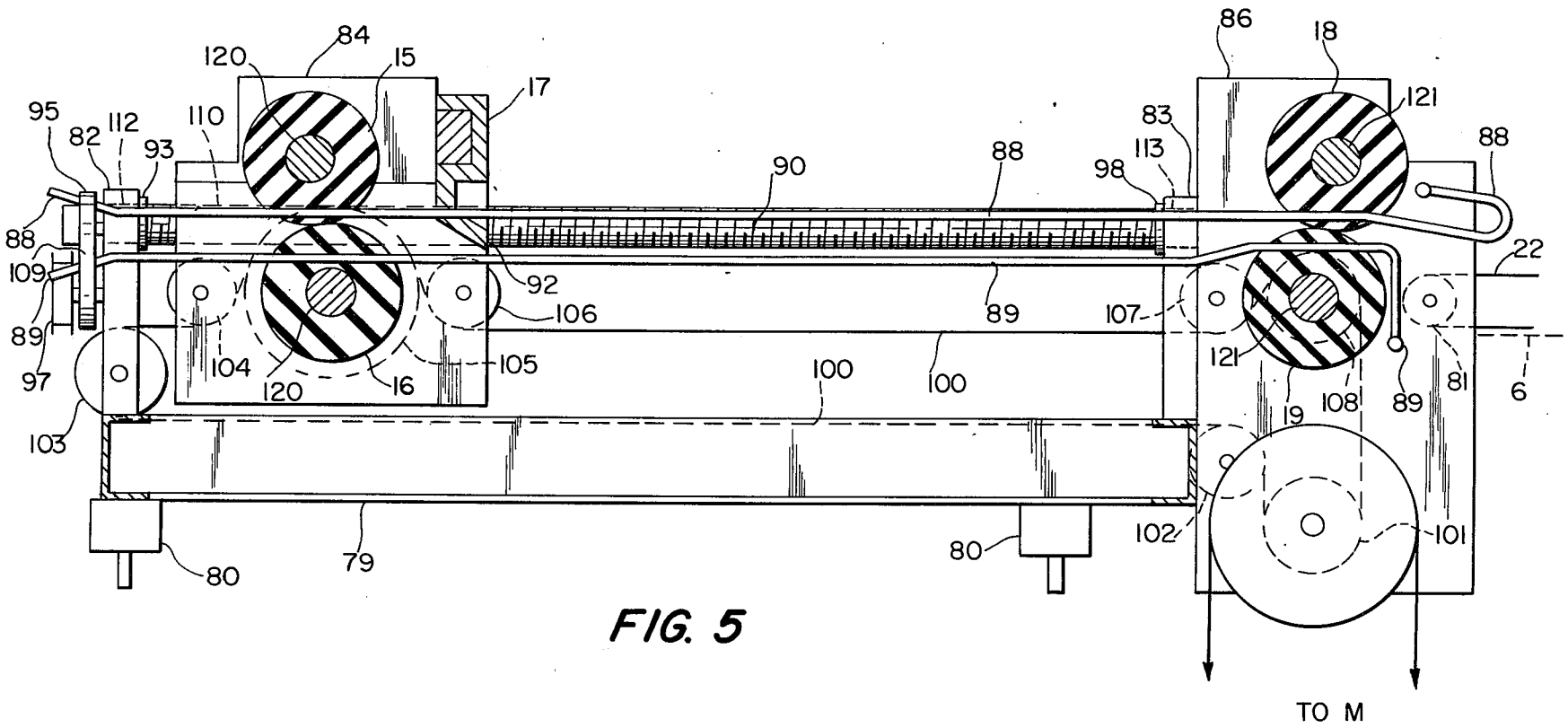
FIG. 5 is a detailed side view of the bursting unit of the invention.
Figure 6:
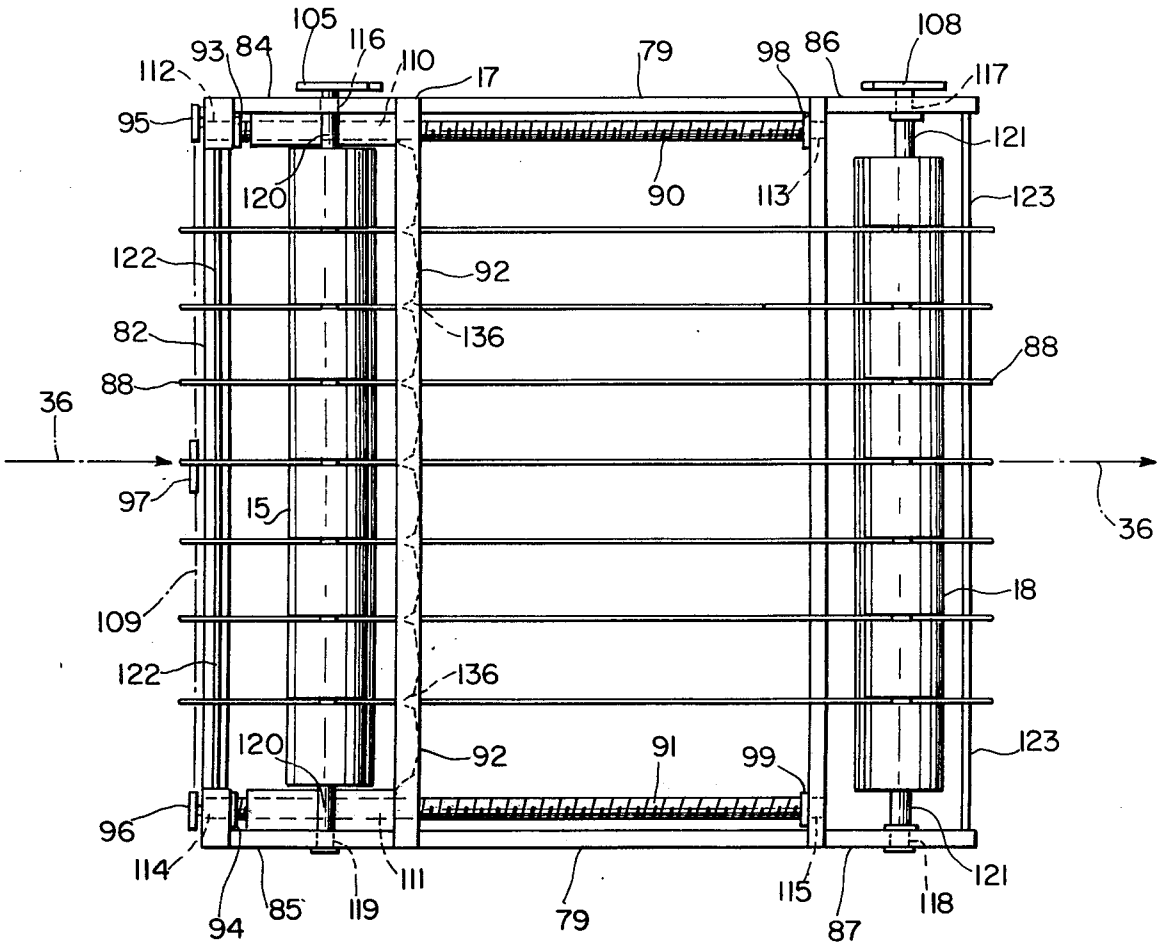
FIG. 6 is a top view of the bursting unit shown in FIG. 5.
Figure 7:
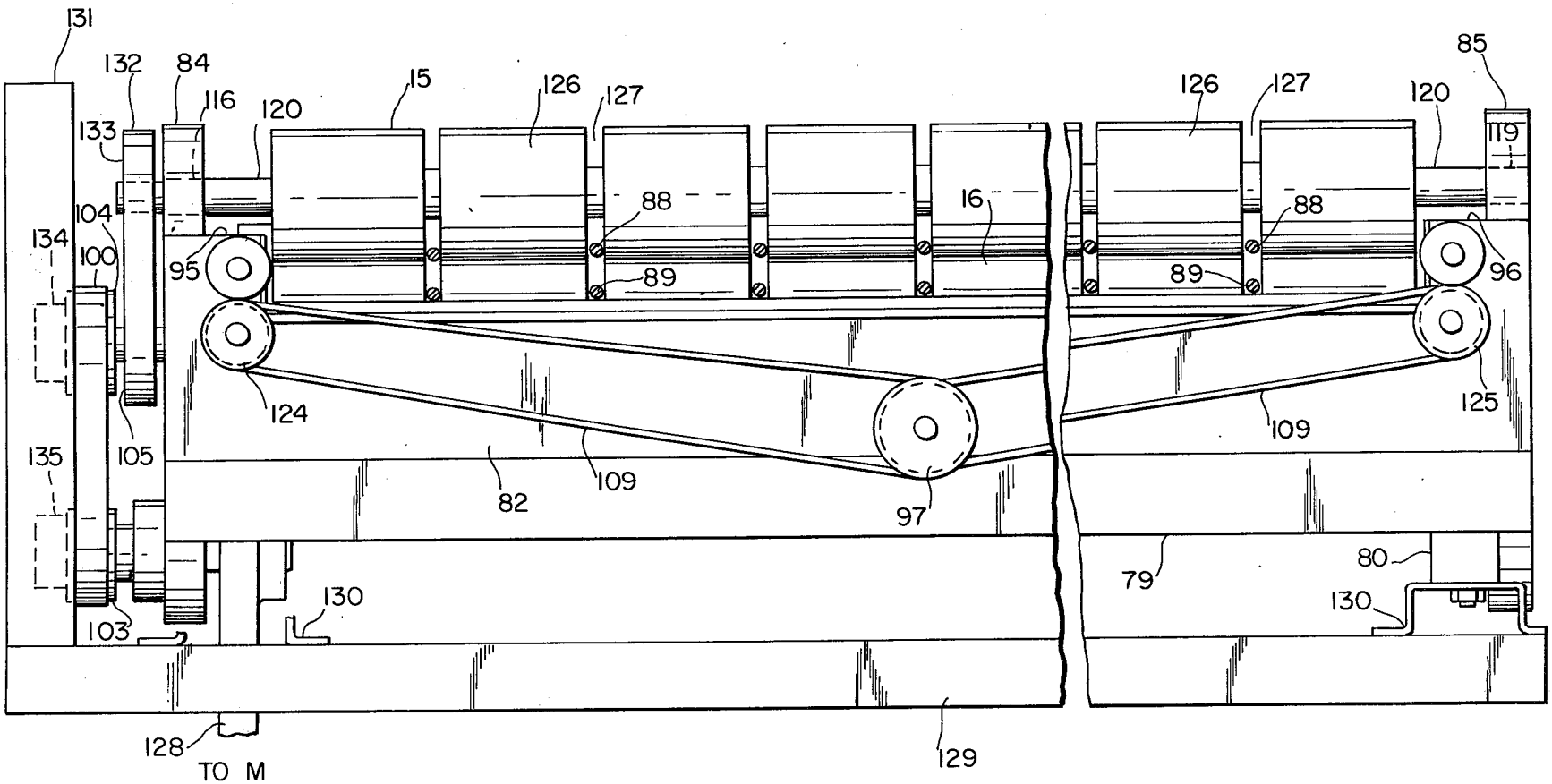
FIG. 7 is a view of the left end of the bursting unit shown in FIG. 5.

With reference to FIGS. 5, 6, and 7, there are shown more detailed views of the bursting module of the invention. Base 79 rests on four cushioned mounts 80 which in turn are mounted on a rigid base 129, as shown generally in FIG. 7. Vertical supports 82 and 83 are mounted at opposite ends of base 79 and are mechanically joined by left and right threaded rods 90 and 91, respectively. Left side threaded rod 90 is rotatably joined at one end to thrust bearing 93 disposed in opening 112 of support 82, and at its other end to thrust bearing 98 disposed in opening 113 of support 83. Likewise, right side threaded rod 91 is rotatably joined at one end to thrust bearing 94 disposed in opening 114 of support 82, and at its other end to thrust bearing 99 disposed in opening 115 of support 83.

High speed rollers 18 and 19 are rotatably supported at the ends of their shafts 121 by openings 117 and 118 disposed in left and right fixed support plates 86 and 87, respectively. Left and right support plates 86 and 87 are securely mounted to opposite ends of support 83 and base 79 in a facing, spaced relationship.

Low speed rollers 15 and 16 are rotatably supported by openings 116 and 119 disposed in left and right movable carriage plates 84 and 85, respectively. Left side carriage plate 84 has a threaded opening 110 which is adapted to engage the threads of left side threaded rod 90. Similarly, right side carriage plate 85 has a threaded opening 111 which is adapted to engage the threads of right side threaded rod 91. Threaded rods 90 and 91 may be of various diameters and threads per inch. For instance, in one embodiment of the invention threaded rods 90 and 91 were five-eights inch in diameter having 11 threads per inch. The only requirement is that the threaded rods be of sufficient cross section to withstand the pressure placed parallel to their axes during the bursting of forms.

Figure 8:
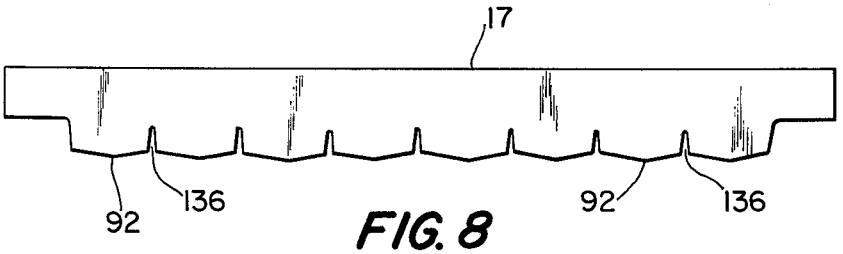
FIG. 8 shows a preferred form of bursting blade adapted for use in the invention.
Figure 8A:
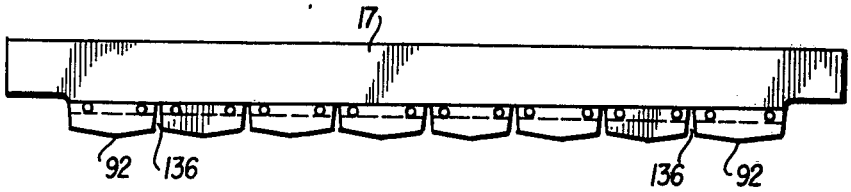
FIG. 8*a* shows an alternate embodiment of the bursting blade shown in FIG. 8.

Bursting blade 17, shown in more detail in FIG. 8, is fixedly mounted on carriage supports 84 and 85 on the exit side of the low speed rollers 15 and 16. The improved bursting blade of the present invention comprises a strip of hard, impact-resistant material having a plurality of arcuate bursting surfaces 92 disposed on the lower edge of the bursting blade 17, with each arcuate bursting surface being separated from its neighbor by guide slots 136. Burster blade 17 may be fashioned from strip steel, aluminum, high-impact molded plastic, or the like. Additionally, the plurality of arcuate bursting surfaces 92 need not be formed as a single unit with bursting blade 17, but may instead be formed separately and releasably secured to the lower side of blade 17 by appropriate fastening means as shown in FIG. 8A. Thus, if a bursting surface 92 became worn or broken, it would not be necessary to replace the entire blade, but merely the individually damaged bursting surface. Of course, it is not necessary that bursting surfaces 93 be arcuate in shape for the invention to function properly; however, it has been found that providing a bursting blade with a plurality of arcuately shaped bursting areas improves the overall reliability of the bursting process. Apparently, in prior art bursters which use a flat edged blade design, no matter how carefully the blade is adjusted bursting will alway take place at one particular point along the length of the forms perforation. The explanation is that it is virtually impossible to make the entire length of a flat-edged bursting blade contact the entire length of the forms perforation area simultaneously. Indeed, such a result may be far from desirable, since if contact were made simultaneously along the length of perforation, the pressure necessary to start and propagate a controlled line of separation would be unreasonably high. However, the prior art flat-edge bursting blades mentioned above, wherein the bursting action takes place at only one point along the perforation, suffer from the obvious disadvantage that once the perforation is begun, the path of the propagating line of separation is uncontrolled, except by the weaknesses present in the perforated zones of the forms. However, as is well known in the art, the depth of perforation and size and weight of the form will determine the ease and "cleanness" of bursting. Therefore, some forms may work quite well with prior art bursting blades, while others may be caused to be torn, shredded, or otherwise improperly burst. As can be seen, the present invention provides a plurality of arcuate bursting areas 92, thus overcoming the disadvantages of prior art flat-edged bursting blades since the plural bursting areas 92 will cause a perforated form to initially separate at a plurality of closely spaced points. The evenness and cleanness of forms separation will be enhanced, and the time for the separations to propagate is correspondingly shorter since a separation must only travel half the distance between each bursting area 92 before meeting a line of separation propagating from its nearest neighbor. Furthermore, since the bursting action occurs at a plurality of points along the line of perforation of the forms, a lighter amount of pressure from the bursting blade against the forms is necessary to accomplish forms separation, thus resulting in quieter operation. Thus, the bursting blade of the present invention causes a more efficient, quiet, and reliable bursting action than prior art bursting blades.

Referring back to FIG. 5, it can be seen that both the low speed rollers, 15 and 16, and the high speed rollers, 18 and 19, are mounted such that their shaft axes are disposed at a slight angle from the vertical. In the preferred embodiment, this angle is approximately 8°, though it could range from 0° up to about 30°. This slight tilt in the axes of both the high and low speed rollers facilitates the guiding and improves the bursting action of the forms. Because of the tilt of the rollers, a form which is engaged between the low speed rollers 15 and 16 and the high speed rollers 18 and 19, would tend to be stretched slightly more across its upward surface than along its lower surface. This differential in upper and lower surface stretching of the form will tend to cause the form to begin separation along its perforations on the upward surface of the forms, thus concentrating the stretching forces along a very narrow portion of the form, as aided by the bursting blade mentioned above. Prior art rollers which are shown merely vertically mounted will tend to concentrate the stretching effect throughout the entire thickness of the form, resulting in higher bursting forces being necessary, greater noise, and less reliable bursting action.

The bearing surfaces 126 of rollers 15, 16, 18, and 19 are preferably comprised of a hard, slightly compressible material having a good coefficient of friction. One such material, by way of example only, is neoprene rubber. Alternatively, the above-mentioned rollers could be comprised solely of cold rolled steel, aluminum, or other hard materials if the bearing surfaces were appropriately roughened or scored to increase their gripping power. With reference to FIGS. 6 and 7, rollers 15, 16, 18, and 19 are identical in construction having a plurality of bearing surfaces 126 disposed along their respective shafts 120 and 121, each such bearing surface being separated from its neighbor by an annular groove 127. The width and spacing of bearing surfaces 126 and annular grooves 127 correspond with the width and spacing of arcuate bursting areas 92 and slots 136, respectively, of bursting blade 17 described above. Additionally, in one embodiment of the invention, upper low speed roller 15 has two pairs of flat areas (not shown) formed into bearing surface 126 to help improve the reliability of the forms feeding process. One pair of flat areas is oppositely disposed from each other about roller 15 for one-half the length of the roller, and the other pair of flat areas is oppositely disposed from each other about roller 15 for the other one-half length of the roller, the two pairs of flat areas being disposed 90° apart from each other about the axis of rotation of roller 15.

Annular grooves 127 and burster blade slots 136 are adapted to receive in a non-contacting arrangement upper wireform guides 88 and lower wireform guides 89 as shown in FIGS. 6 and 7. Wireform guides 88 and 89 define an area between the upper low speed and high speed rollers and the lower low speed and high speed rollers through which the continuous forms may travel. Both upper and lower wireform guides 88 and 89 are similar in construction. Each guide is comprised of a plurality of parallely disposed stiff metal wires held in a spaced apart relationship by perpendicular tie wires 122 and 123 at their respective low speed and high speed ends. Of course, it is not necessary that upper and lower wireform guides 88 and 89 be comprised of stiff metal wires, but could take the form of parallel metal strips or be composed of a plastic-type material, rather than metal. Perpendicular tie wires 122 and 123 of upper and lower guides 88 and 89 are used to mount wireform guides 88 and 89 in a facing, spaced apart relationship in the low speed guide support 82 and high speed supports 86 and 87. The upper and lower wireform guides are arranged such that the plurality of parallely disposed wires are disposed parallel to the direction of travel of the continuous forms and that the plane of the upper and lower wireform guides is substantially parallel to the plane of the path of the continuous forms in the bursting module.

As is shown in FIG. 5, the low speed opening of wireforms 88 and 89 are spread apart slightly to more readily receive the entering continuous forms. A continuous form would be drawn between the upper and lower low speed rollers 15 and 16 as they rotated. The form would then be propelled beneath burster bar 17, having a plurality of bursting areas 92 disposed thereon, and thence to the rotating upper and lower high speed rollers 18 and 19. At this point, the speed differential between the high speed and low speed rollers would cause the forms to be tightly stretched. In the preferred embodiment, the bursting module would be adjusted as described below to cause the preweakened areas or perforations 32 of continuous forms 9, such as shown in FIG. 2, to arrive at a point directly beneath the bursting areas 92 of bursting bar 17 at the moment of maximum stretch. The action of the oppositely tilted low and high speed rollers in conjunction with the path of the forms defined by upper and lower wireform guides 88 and 89 causes the perforations 32 of the forms to bear upward against the bursting areas 92 of bursting bar 17, thus initiating a line of separation along perforations 32 of the continuous forms 9. When separation is complete, tilted high speed rollers 18 and 19 will cause the separated form to be ejected toward the stacking means 6, shown only partially in FIG. 5. The upper and lower wireform guides 88 and 89 are shaped in a slight downward curve at the high speed end to help direct the burst forms downward toward the stacking means 6.

It may be noted that a series of pulleys and belts and associated mounting hardware shown in FIGS. 5, 6, and 7 as reference numerals 100–108, 128 and 131–135, are chosen to drive the low and high speed rollers through the use of a single variable speed motor M. Of course, sprockets and timing chains could be provided in lieu of timing belts and pulleys. However, timing belts and pulleys are to be preferred since they are quieter in operation and less trouble prone than their sprocket and chain counterparts. The size of the low speed and high speed pulleys 105 and 108 respectively, are chosen to give a constant ratio of high speed roller to low speed roller velocity of around 1.75 to 1. Other ratios obviously could be used, but it has been found that in practicing this invention that the most uniform results on a wide variety of papers are achieved near the above-mentioned ratio. In addition, motor M is continuously variable, through well known electronic means, which allows an operator to select a bursting speed from just above zero feet per minute to 300 feet per minute. Such a speed adjustment is necessary since different forms will have different optimum bursting speeds depending on their weight, degree of perforation, relative humidity, and other environmental factors. It will be noted from FIG. 5 that all pulleys remain fixed with respect to base 79, except for those mounted on the left-side movable low speed roller support 84, denoted at 104 and 105. The result is that the movable low speed roller unit may move anywhere along the length of threaded rods 90 and 91, but still have its rollers 15 and 16 driven directly by belt 100. Additionally, the belts 22 of shingling stacker 6 are driven at about one-sixth times the linear velocity of high speed rollers 18 and 19 by transverse roller bar 81, which is in turn driven through a series of belts and pulleys (not shown) by motor M. Transverse roller bar 81 is rotatably supported by openings provided in high speed supports 86 and 87. The bed of shingling stacker 6 may be locked horizontally in place by suitable fastening means. When it is desired to store the bursting apparatus, the bed of shingling stacker 6 may be released from its horizontal position down into a vertical recess 28 provided for it in the side of cabinet 1 as shown in FIG. 1.

With reference to FIG. 7 there is shown a detailed view of the low speed end of the bursting apparatus, showing in particular how the left and right threaded rods 90 and 91 are driven by synchronous motor 97 through the use of belts 109 and two sets of gears denoted at 95, 96, and pulley and gear combination denoted at 124 and 125. Rotation of synchronous motor 97 causes belts 109 to turn left hand pulley 124 and right hand pulley 125, which in turn drive gears 95 and 96, respectively. Gear 95 is directly coupled to the left hand threaded rod 90. Similarly, gear 96 is directly coupled to the right threaded rod 91. Thus, rotation of synchronous motor 97 will cause a corresponding rotation of left and right threaded rods 90 and 91 about their axes. Since both left and right threaded rods 90 and 91 engage complementary threads formed in the left and right low speed roller supports 84 and 85, as shown in FIG. 6, rotation of threaded rods 90 and 91 will cause the entire low speed roller unit and bursting blade assembly to travel toward or away from the fixed high speed rollers, as the operator chooses. Of course, synchronous motor 97 could be replaced by a simple hand crank, but it is quicker and more convenient to adjust for the length of the forms by use of motor 97.

In operation, the distance between movable low speed rollers 15 and 16 and fixed high speed rollers 18 and 19 would be adjusted so as to place the arcuate bursting areas 92 of burster bar 17, which is attached to the low speed roller unit, directly over a preweakened zone or perforations disposed on a set of continuous forms fed into the bursting module. Appropriate scale or indicia means could be placed near or adjacent the arcuate bursting areas 92 to allow an operator to more easily adjust the distance between the movable low speed roller and bursting bar and the fixed high speed rollers for different size forms.

Thus, it can be seen that the above-described bursting module is easily adjustable for a wide variety of forms lengths. The technique of moving the low speed rollers as a unit by the use of dual threaded rods, while keeping the high speed rollers fixed, eliminates the need for massive stamped-out side plates and complicated toothed track arrangements used to support and separate the movable from the fixed rollers as employed in prior art bursters. Since only the threaded rods must withstand high stress during the bursting of a form, a considerable amount of weight savings is accomplished. In addition, the use of dual threaded rods to distribute the forces during bursting reduces much mechanical noise since the source of much of the noise, the mechanical vibration of the massive side plates in prior art bursters, has been eliminated. Also, in prior art bursters in which the high speed rollers have been movable, shingling stackers have had to be rigidly attached to their high speed roller units, for movement therewith. These prior art arrangements using movable high speed rollers attached to a movable shingling stacker are mechanically complex and physically difficult for an operator to adjust. Of course, the burster could be rearranged so as to have the low speed rollers fixed and the high speed rollers mounted on a movable carriage which is adjustably spaced from the fixed low speed rollers by means of two parallel threaded rods. However, the arrangement of the instant invention, wherein the low speed rollers are movable and the high speed rollers remain fixed, is to be preferred since it allows a compact folding shingling stacker to be used advantageously in the invention.

In addition, the use of straight through wireform guides provides a simple, economical, yet reliable means for ensuring that the forms will be correctly guided through the burster without jamming or skewing, and eliminates the need for solid base plates and rollers as used in prior art bursters. Further, the open nature of the wireform guides helps eliminate undesirable aerodynamic problems created by non-laminar airflow around thin forms. Also, since the forms will be correctly guided and burst no matter at what location they are fed into the low-speed rollers, the bursting apparatus of the invention may be used with forms of various widths without the need to adjust rollers or form guides in the bursting section when changing from one form to another.

It can also be seen that the use of dual tilted fixed high speed and movable low speed rollers, in conjunction with a bursting blade having a plurality of arcuate shaped bursting areas, will cause a more uniform and quieter bursting action over that of prior art bursting apparatus. Finally, since the bursting apparatus of the present invention is modular in design, it may be used in conjunction with other forms handling apparatus or printers, or by itself as a desk top or table top unit, for example, without the use of the forms guiding or trimming module as described above. In such a case, the operator would merely feed the forms directly into the rotating low speed rollers 15 and 16 and receive the burst copies at the exit of the high speed rollers 18 and 19.

It can be seen from the foregoing discussion of the guiding, trimming, and bursting modules that the modular bursting apparatus of the present invention is quiet, light in weight, easy to operate and adjust, adaptable to a variety of form thicknesses and sizes, and offers many advantages in construction and operation over the prior art.

What is claimed is:

1. Bursting apparatus for continuous forms comprising:

a first pair of rotating rollers;

a second pair of rotating rollers mounted on a movable carriage and rotating at a velocity different from that of said first pair of rollers, said second pair of rollers being adjustably spaced from said first pair of rollers by a pair of threaded rods, each pair of rollers of said first and second roller pairs defining a nip for gripping and feeding said continuous forms, wherein said first and second pairs of rollers define a substantially horizontal plane of travel therebetween for said continuous forms and wherein said first and second pairs of rollers are disposed such that a plane passing through the axes of one of said pairs of rollers is angularly tilted from the vertical in an opposite rotational sense from a plane passing through the axes of the other pair of rollers such that each said pair of rollers has a nip plane tangent to each roller but skewed with respect to said plane of travel of said forms; and a bursting blade mounted on said movable carriage for cooperating with preweakened zones on said forms.

2. The invention of claim 1 wherein said first and second pairs of rotating rollers each comprise identical pairs of substantially tubular shaped rollers, wherein each said pair of rollers comprises an upper roller and a lower roller, said upper and lower rollers disposed in a substantially contacting, facing relationship along said nip plane.

3. The invention of claim 1 wherein said first pair of rotating rollers first receives said forms and wherein said second pair of rotating rollers rotates at a velocity higher than said first pair of rotating rollers.

4. The invention of claim 1 wherein said second pair of rotating rollers first receives said forms and wherein said first pair of rotating rollers rotates at a velocity higher than said second pair of rotating rollers.

5. The invention of claim 1 wherein said bursting blade comprises a strip of substantially rigid material having a plurality of arcuately shaped areas disposed thereon, said arcuately shaped areas disposed substantially parallel with said preweakened zones on said forms.

6. The invention of claim 5 wherein said arcuately shaped areas are releasably attached to said bursting blade.

7. Modular bursting apparatus for continuous forms comprising:

flanged forms guiding means and margin trimming means, each adjustable for different width forms through the use of releasable leaf-spring clamping means attached to said guiding means and said trimming means; and bursting means, for receiving said forms from said guiding and trimming means, comprising:

a first pair of rotating rollers;

a second pair of rotating rollers mounted on a movable carriage and rotating at a velocity different from that of said first pair of rollers, said second pair of rollers being adjustably spaced from said first pair of rollers by a pair of threaded rods, each pair of rollers of said first add second roller pairs defining a nip for gripping and feeding said continuous forms, wherein said first and second pairs of rollers define a substantially horizontal plane of travel therebetween for said continuous forms and wherein said first and second pairs of rollers are disposed such that a plane passing through the axes of one of said pairs of rollers is angularly tilted from the vertical in an opposite rotational sense from a plane passing through the axes of the other pair of rollers such that each said pair of rollers has a nip plane tangent to each roller but skewed with respect to said plane of travel of said forms; and a bursting blade mounted on said movable carriage for cooperating with preweakened zones on said forms.

8. The invention of claim 7 wherein said flanged forms guiding means further comprises:

an arcuately shaped surface;

a flange disposed substantially perpendicular to said arcuate surface; and releasable hold-down means fastened adjacent to said flange, for releasably holding said continuous forms in sliding, contacting engagement with said arcuately shaped surface.

9. The invention of claim 7 wherein said leaf-spring clamping means further comprises:

a housing;

a shaft laterally-disposed within said housing;

a push-button disposed in an opening provided in said housing;

a plunger connected to said push-botton;

a leaf-spring having a first end and a second end, said first end being connected to said plunger and said second end being fastened to said housing; and a block of resilient material attached to said first end of said leaf-spring, a face of said resilient block being in releasable contacting engagement with said shaft.

10. The invention of claim 9 wherein said resilient block further comprises a substantially rectangular block of moderately resilient and compressible material, having a V-shaped groove disposed on said face of said block which is in contacting engagement with said shaft.

11. The invention of claim 9 wherein said resilient block is composed of urethane.

12. Modular bursting apparatus for continuous forms comprising:

flanged, arcuate forms guiding means and trimming means, each being transversely adjustable for different width forms and securably lockable with respect to each other through the use of releasable leaf-spring clamping means attached to said guiding means and said trimming means; and bursting means, for receiving said forms from said guiding and trimming means, comprising: a pair of low speed rollers and a pair of high speed rollers, wherein said low speed rollers are mounted on a movable carriage adjustably spaced from said high speed rollers by two parallel threaded rods, each pair of rollers of said high speed and low speed roller pairs defining a nip therebetween for gripping and feeding said continuous forms, and wherein said high speed and low speed roller pairs define a substantially horizontal plane of travel therebetween for said continuous forms and wherein said high speed and low speed pairs of rollers are disposed such that a plane passing through the axes of one of said pairs of rollers is angularly tilted from the vertical in an opposite rotational sense from a plane passing through the axes of the other pair of rollers such that each said pair of rollers has a nip plane tangent to each roller but skewed with respect to said plane of travel of said forms;

wire-form guiding means, substantially enclosing said plane of travel of said continuous forms between said low speed and high speed rollers; and a bursting blade mounted on said movable carriage, having a plurality of arcuate bursting areas disposed thereon for separating preweakened zones on said forms.

13. The invention of claim 12 wherein said wire-form guiding means comprises:

a first guide having a first set of a plurality of parallely disposed guiding members; and a second guide having a second set of a plurality of parallely disposed guiding members, wherein said first and second guides are arranged in a spaced, facing relationship such that said first and second sets of parallely disposed guiding members are disposed parallel to said plane of travel of said continuous forms.

14. The invention of claim 13 wherein said guiding members are comprised of a substantially rigid wirelike material.

15. The invention of claim 13 wherein said guiding members are comprised of a substantially rigid striplike material.

16. The invention of claim 12 wherein said bursting blade comprises a strip of substantially rigid material, and wherein said arcuate bursting areas are separated by a plurality of guide slots for non-contacting engagement with said wire-form guiding means.

17. The invention of claim 16 wherein said arcuate bursting areas are releasably attached to said bursting blade.

18. The invention of claim 12 wherein said high speed and low speed rollers have a plurality of annular grooves disposed between bearing surfaces of said rollers for non-contacting engagement with said wire-form guiding means.

19. Modular bursting apparatus for continuous forms comprising:

a frame;

means, attached to said frame, for holding said forms to be burst;

dual, flanged arcuate forms guiding means having means attached to said guiding means for releasably holding said continuous forms in sliding, contacting engagement with said guiding means, said guiding means being transversely adjustable and securably lockable along a first shaft mounted on said frame through a first releasable pushbutton leaf-spring clamping means attached to said guiding means and having a first block of resilient material attached to said first leaf-spring clamping means for cooperating with said first shaft;

dual trimming means, said trimming means being transversely adjustable and securably lockable along a second shaft mounted on said frame, and parallely disposed with respect to said first shaft, through a second releasable pushbutton leaf-spring clamping means attached to said trimming means and having a second block of resilient material attached to said second leaf-spring clamping means for cooperating with said second shaft;

means mounted on said frame for decollating and retrieving copies of said continuous forms from said guiding and trimming means;

bursting means comprising: a pair of low speed rollers and a pair of high speed rollers, wherein said high speed rollers are rotatably mounted on said frame, and said low speed rollers are rotatably mounted on a movable carriage for receiving said forms from said guiding and trimming means, said low speed rollers being adjustably spaced from said high speed rollers by two parallel threaded rods rotatably attached to said frame and said movable carriage, each pair of rollers of said high speed and low speed roller pairs defining a nip for gripping and feeding said continuous forms, and wherein said high speed and low speed roller pairs define a substantially horizontal plane of travel therebetween for said continuous forms and wherein said high speed and low speed pairs of rollers are disposed such that a plane passing through the axes of one of said pairs of rollers is angularly tilted from the vertical in an opposite rotational sense from a plane passing through the axes of the other pairs of rollers such that each said pair of rollers has a nip plane tangent to each roller but skewed with respect to each other and to said plane of travel of said forms;

a first and second set of rigid wire-form guiding members attached to said frame, wherein said first and second sets of guiding members are arranged in a spaced, facing relationship substantially enclosing said plane of travel of said continuous forms between said low speed and high speed rollers; and a bursting blade mounted on said movable carriage, having a plurality of arcuate bursting areas disposed thereon for separating preweakened zones of said forms, and wherein said arcuate bursting areas are separated by a plurality of guide slots for non-contacting engagement with said wire-form guiding means; and stacking means mounted on said frame adjacent to said high speed rollers, releasably foldable into said bursting means, for receiving and stacking burst forms.

20. The invention of claim 19 wherein said high speed and low speed rollers each comprise identical pairs of substantially tubular shaped rollers disposed in a contacting, facing relationship, and wherein said high speed and low speed rollers are oppositely tilted in an angular range of 1° to 30° from the vertical.

21. The invention of claim 19 wherein said high speed and low speed rollers have a plurality of annular grooves disposed between bearing surfaces of said rollers for non-contacting engagement with said wire-form guiding means.

22. The invention of claim 19 wherein said arcuate bursting areas are releasably attached to said bursting blade.

23. The invention of claim 19 wherein said means for holding said forms to be burst comprises a substantially planar wire-form rack releasably foldable into said frame.

24. The invention of claim 19 wherein said stacking means comprises a shingling stacker.

* * * * *